US008857298B2

(12) United States Patent
Davidson et al.

(10) Patent No.: US 8,857,298 B2
(45) Date of Patent: Oct. 14, 2014

(54) TOOL RELEASE MECHANISM WITH SPRING-RECEIVING GUIDED ELEMENT

(75) Inventors: John B. Davidson, Chicago, IL (US); C. Robert Moon, Joliet, IL (US)

(73) Assignee: Joda Enterprises, Inc., Chicago, IL (US)

( * ) Notice: Subject to any disclaimer, the term of this patent is extended or adjusted under 35 U.S.C. 154(b) by 0 days.

(21) Appl. No.: 13/334,356

(22) Filed: Dec. 22, 2011

(65) Prior Publication Data

US 2013/0160614 A1 Jun. 27, 2013

(51) Int. Cl.
*B25B 23/16* (2006.01)
*B25G 3/18* (2006.01)

(52) U.S. Cl.
USPC ..... 81/177.85; 403/322.1

(58) Field of Classification Search
USPC ..... 81/177.85, 177.75, DIG. 6, 60, 177.7; 403/322.1, 324, 325, 327, 328
See application file for complete search history.

(56) References Cited

U.S. PATENT DOCUMENTS

| | | | | |
|---|---|---|---|---|
| 1,864,466 A | | 6/1932 | Peterson | |
| 1,940,405 A | | 12/1933 | Englund | |
| 2,190,081 A | * | 2/1940 | Pfauser | 81/177.85 |
| 3,118,696 A | * | 1/1964 | Resare | 81/177.85 |
| 3,208,318 A | | 9/1965 | Roberts | |
| 4,420,995 A | | 12/1983 | Roberts | |
| 4,571,113 A | | 2/1986 | Coren | |
| 4,614,457 A | | 9/1986 | Sammon | |
| 4,768,405 A | | 9/1988 | Nickipuck | |
| 4,770,073 A | | 9/1988 | Palm | |
| 4,777,852 A | * | 10/1988 | Herman et al. | 81/63.1 |
| 4,781,085 A | | 11/1988 | Fox, III | |
| 4,848,196 A | | 7/1989 | Roberts | |
| 5,214,986 A | | 6/1993 | Roberts | |
| 5,233,892 A | | 8/1993 | Roberts | |
| 5,289,745 A | | 3/1994 | Beardsley | |
| 5,291,809 A | | 3/1994 | Fox, III et al. | |
| 5,333,523 A | | 8/1994 | Palm | |
| D355,342 S | | 2/1995 | Davidson et al. | |

(Continued)

FOREIGN PATENT DOCUMENTS

| | | |
|---|---|---|
| DE | 38 04 129 | 9/1988 |
| EP | 1457291 | 9/2004 |

(Continued)

OTHER PUBLICATIONS

PCT/US2012/070365 International Search Report dated Feb. 26, 2013 (2 pages).

(Continued)

*Primary Examiner* — Hadi Shakeri
(74) *Attorney, Agent, or Firm* — Brinks Gilson & Lione; G. Peter Nichols

(57) ABSTRACT

Coupling mechanisms for engaging and releasing a tool attachment such as a socket from a drive element include an engaging element and an actuating element. The actuating element can include a collar or other manually-accessible part, and various features allow for a relatively small outside diameter for the collar or other part. These features include configuring the actuating element to contact the engaging element within the drive element, placing the biasing elements within the drive element, and forming guides for parts of the actuating element within the drive element. A guided element is coupled between the engaging element and a biasing element and is arranged to partially overlap the biasing element.

19 Claims, 7 Drawing Sheets

(56) References Cited

U.S. PATENT DOCUMENTS

| | | | |
|---|---|---|---|
| D359,668 | S | 6/1995 | Roberts et al. |
| 5,433,548 | A | 7/1995 | Roberts et al. |
| 5,501,125 | A | 3/1996 | Roberts et al. |
| 5,644,958 | A | 7/1997 | Roberts et al. |
| 5,660,491 | A | 8/1997 | Roberts et al. |
| D397,597 | S | 9/1998 | Davidson et al. |
| 5,851,151 | A | 12/1998 | Reynolds |
| 5,911,800 | A | 6/1999 | Roberts et al. |
| 6,044,730 | A | 4/2000 | Roberts et al. |
| 6,098,500 | A | 8/2000 | Roberts et al. |
| 6,109,140 | A | 8/2000 | Roberts et al. |
| 6,145,416 | A | 11/2000 | Bonniot |
| 6,164,169 | A | 12/2000 | Goff |
| 6,182,536 | B1 | 2/2001 | Roberts et al. |
| 6,199,457 | B1 | 3/2001 | Hoff et al. |
| 6,205,890 | B1 | 3/2001 | Roberts et al. |
| 6,755,100 | B1 | 6/2004 | Chen |
| 6,920,810 | B1 | 7/2005 | Thompson et al. |
| 7,398,713 | B2 | 7/2008 | Davidson |
| 2005/0229752 | A1 | 10/2005 | Nickipuck |
| 2009/0255381 | A1 | 10/2009 | Davidson et al. |
| 2011/0296962 | A1 | 12/2011 | Davidson et al. |

FOREIGN PATENT DOCUMENTS

| | | |
|---|---|---|
| WO | WO 90/02634 | 3/1990 |
| WO | WO 03/047817 | 6/2003 |
| WO | WO 2007/133360 | 11/2007 |

OTHER PUBLICATIONS

International Search Report for Corresponding International Application No. PCT/US2007/08950 Dated Feb. 29, 2008 (2 pages).

Supplementary European Search Report for Application No. EP07776966 Dated Sep. 28, 2009 (three pages).

International Search Report for Application No. PCT/US07/11344 Dated Mar. 27, 2008 (two pages).

* cited by examiner 4
10
11
12
14
16
18
20
22
24
28
30
32
34
38
42
44
46
48
60
62
130
132
136
138
140
142
D1
D2

TOOL RELEASE MECHANISM WITH SPRING-RECEIVING GUIDED ELEMENT

FIELD OF THE INVENTION

The present invention relates to a tool release mechanism with a spring-receiving guided element.

BACKGROUND

Torque transmitting tools with a drive element having a drive stud configured for detachable coupling to a tool attachment such as a socket have in the past been provided with mechanisms that allow an operator to select between an engaging position, in which the tool attachment is secured to the drive stud and accidental detachment is substantially prevented, and a releasing position, in which forces tending to retain the tool attachment on the drive stud are reduced or eliminated.

In the tools described in U.S. Pat. No. 5,911,800, assigned to the assignee of the present invention, a releasing spring 50 biases a locking pin 24 upwardly to a release position, while an engaging spring 48 of greater spring force biases the locking pin 24 downwardly to an engaging position (see, for example, FIGS. 1, 3, and 4; col. 3, line 66 to col. 4, line 20; col. 4, lines 49-59). By moving a collar 34 away from the drive stud end of the tool, the engaging spring 48 is manually compressed, thereby allowing the releasing spring 50 to move the locking pin 24 to a releasing position.

U.S. Pat. No. 8,024,997, assigned to the assignee of the present invention, shows a coupling mechanism with a biasing element or an engaging spring 62 that bears on a guided element 30 to bias the guided element toward an engaging element 18. It is described that the guided element may be shorter in the longitudinal direction to provide a longitudinally compact mechanism. While such a construction of the guided element allows a shorter axial construction of the mechanism, at least one of the guided element and the biasing element may tend to become skewed within the guide as a result of movement of the engaging spring 62 with the guided element.

The guided element of the present invention solves that and other problems by providing a guided element that at least partially overlaps the biasing element along the longitudinal axis. By providing such a construction of the guided element, any tendency for the guided element or biasing element to become skewed within the guide is minimized, if not entirely prevented. In addition, movement of the biasing element with respect to the guided element is constrained by the construction of the guided element according to the present invention.

Advantageously, a structure according to the present invention permits achieving a maximizing of the force exerted by the biasing element on the guided element while minimizing the length of the mechanism. It is possible therefore, to provide a greater biasing effect in a shorter space.

SUMMARY

By way of introduction, the attached drawings show different mechanisms for altering the engagement forces between a drive element and a tool attachment. All of these mechanisms are compact, and they extend only a small distance beyond the outside diameter of the drive element. Each mechanism includes a spring-receiving guided element.

The scope of the present invention is defined solely by the appended claims, which are not to be limited to any degree by the statements within this summary or the preceding background discussion.

DETAILED DESCRIPTION OF PREFERRED EMBODIMENTS

Figures 1, 2, 3:
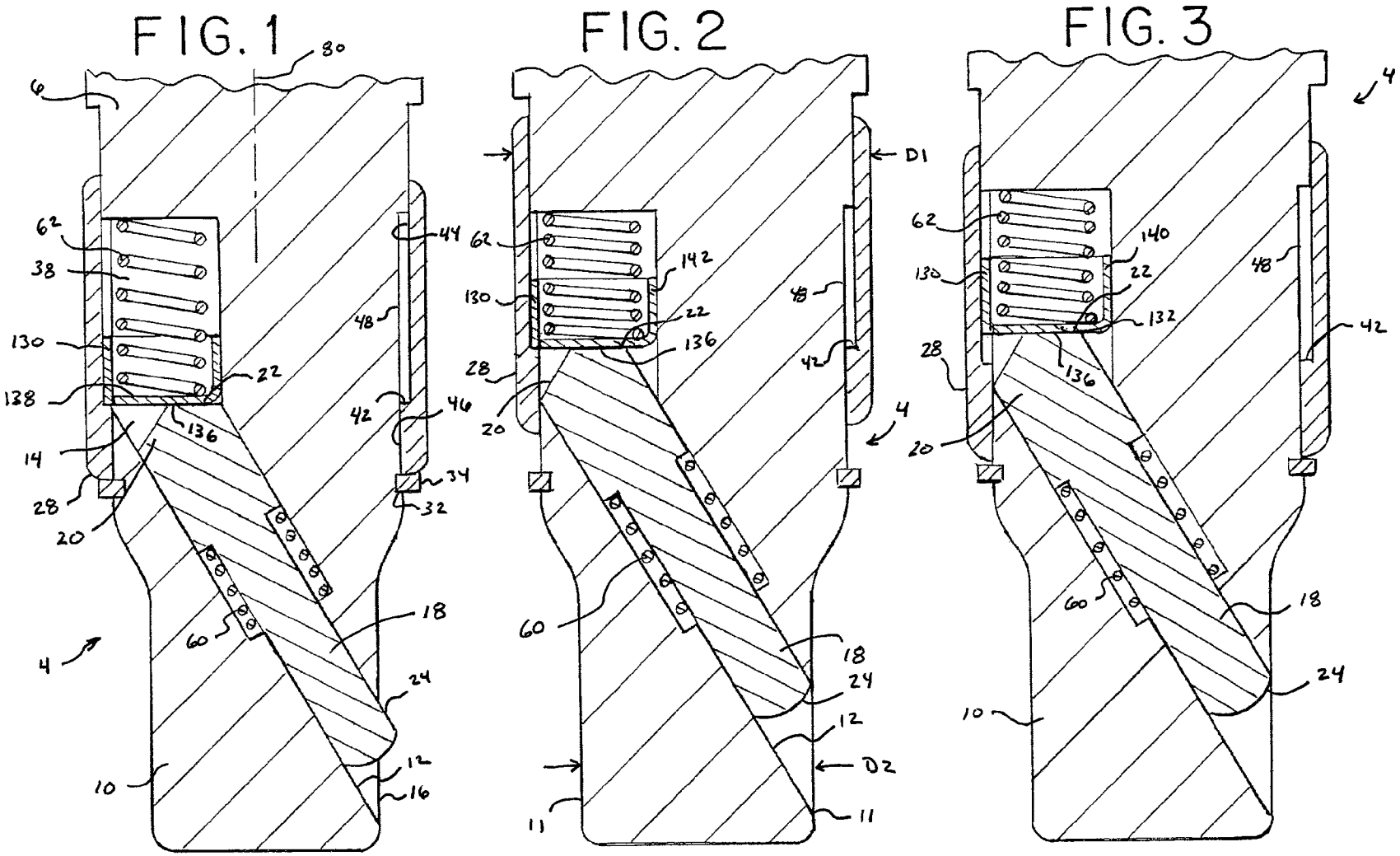
FIGS. 1, 2, and 3 are longitudinal sectional views of a tool that includes a first embodiment of a mechanism for altering engagement forces, showing the mechanism in three different positions as well as the relative location of the spring-receiving guided element.

FIG. 1 shows a drive element 4 of a tool such as a hand, impact, or power tool. For example, the tool may be a wrench, ratchet, extension bar, universal joint, T-bar, breaker bar, speeder, or the like. The drive element is designed to engage and transmit torque to a tool attachment such as a socket (not shown). The drive element 4 includes an upper portion 6 and a drive stud 10. The drive stud 10 is configured for insertion into a tool attachment, and it typically defines an out-of-round cross-section. For example, the drive stud 10 may have a square, hexagonal or other non-circular shape in cross section. The upper portion 6 will often define a circular cross section, though this is not required. The drive element 4 includes a mechanism for altering engagement forces between the tool and a tool attachment, as described below.

In this example, a passageway 12 extends into the first portion 6 and the drive stud 10, and the passageway 12 is oriented at an oblique angle to a longitudinal axis 80 of the drive element 4. The passageway 12 includes an upper opening 14 and a lower opening 16, and the lower opening 16 is positioned at a portion of drive stud 10 configured for insertion into a tool attachment (not shown). As used throughout this specification and the following claims, the term "tool attachment" refers to any attachment configured to be engaged by the drive stud 10, including but not limited to sockets, universal joints, extension bars, certain ratchets, and the like.

The drive element 4 further includes an engaging element 18 moveably disposed in the passageway 12. The engaging element 18 of this example is formed in one piece, and it includes an upper portion 20 and a lower portion 24. As used throughout this specification and the following claims, the term "engaging element" refers to one or a plurality of coupled components, at least one of which is configured for releasably engaging a tool attachment. Thus, this term encompasses both single part engaging elements (e.g., element 18 in FIG. 1) and multi-part assemblies (e.g., the multiple part engaging elements shown in FIGS. 4-6, described below). The passageway 12 acts as a guide for the engaging element 18.

The primary function of the engaging element 18 is to hold a tool attachment on the drive stud 10 during normal use. The lower portion 24 of the engaging element 18 is configured to engage a tool attachment when the engaging element 18 is in an engaging position, and to relax or terminate engagement with the tool attachment when the engaging element 18 is in a releasing position. As used throughout this specification and the following claims, the term "engaging position" does not imply locking the tool attachment in place against all conceivable forces tending to dislodge the tool attachment. On the other hand, the term "engaging position" connotes a positive retention of the tool that resists pulling off a tool attachment to a degree greater than is customarily the case with traditional spring-loaded ball retention mechanisms heretofore used in tools.

Though illustrated as a cylindrically-symmetrical pin in FIG. 1, the engaging element 18 may take various shapes. If desired, the engaging element 18 may be provided with an out-of-round cross section and the passageway 12 may define a complementary shape such that a preferred rotational orientation of the engaging element 18 in the passageway 12 is automatically obtained (i.e., the engaging element need not be rotatable in the passageway 12). The terminus of the lower portion 24 of the engaging element 18 may be formed in any suitable shape and, for example, may be rounded as shown in U.S. Pat. No. 5,911,800, assigned to the assignee of the present invention.

The drive element 4 carries an actuating element which in this preferred embodiment includes a collar 28 and a spring-receiving guided element 130. The collar 28 slides longitudinally along a path that is essentially parallel to the longitudinal axis 80 of the drive element 4. As shown in FIG. 1, the collar 28 may be held in place with a retaining element 34 such as a split ring or C-ring positioned in a corresponding groove 32 in the drive element 4. Any other retention member may be used that prevents separation of the collar 28 from the drive element 4. As illustrated in FIG. 1, the collar 28 is shown in an optional rest position, in which an end surface of the collar 28 rests on the retaining element 34.

Figure 6:
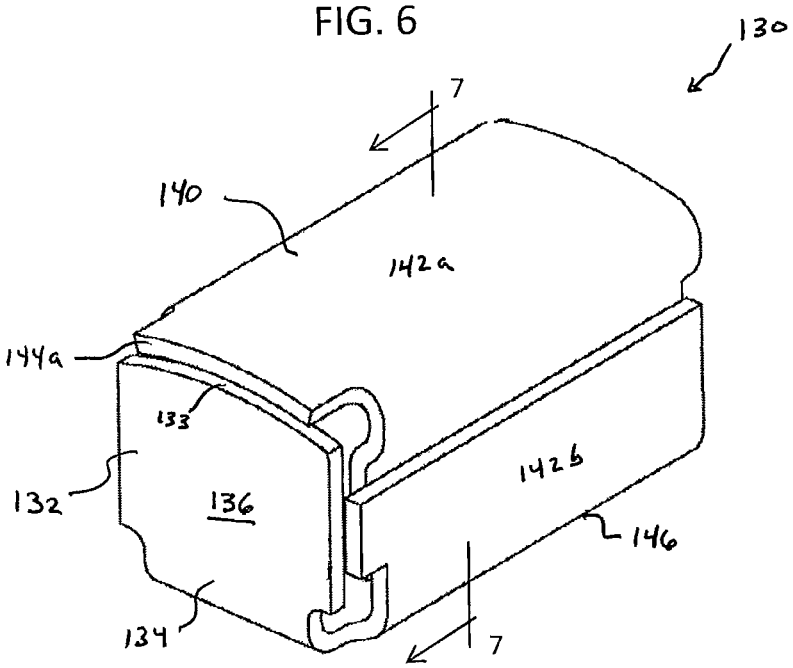
FIG. 6 is a perspective view of an embodiment of a spring-receiving guided element.
Figure 7:
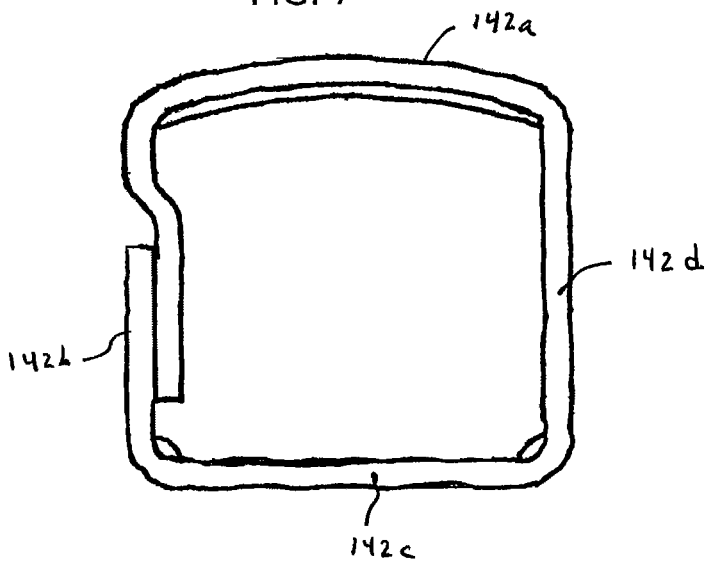
FIG. 7 is a cross-sectional view taken along line 7-7 of FIG. 6.

The spring-receiving guided element 130 is disposed between the biasing element 62 and the engaging element 18 and partially overlaps the baising element 62 along the longitudinal axis 80. The spring-receiving guided element 130 slides in a guide 38 in the drive element 4. For example, the guide 38 may be a milled channel in the drive element 4, and the spring-receiving guided element 130 may be received in the channel. In this example, the guide 38 is oriented parallel to the longitudinal axis 80. The spring-receiving guided element 130 includes a first portion 132 that, as shown in FIG. 6 comprises a plate 134 that defines a cam surface 136 at one end adjacent the engaging element 18, and the upper portion 20 of the engaging element 18 forms a cam surface 22 that slides across the cam surface 136 as the spring-receiving guided element 130 moves along the guide 38. In this example, the region of contact between the engaging element 18 and the cam surface 136 remains within the drive element 4 for all positions of the engaging element 18 and the spring-receiving guided element 130. Also, the spring-receiving guided element 130 may be made shorter in the longitudinal direction (i.e., shorter in the direction parallel to the longitudinal axis 80 when oriented as shown in FIG. 1) to provide a longitudinally compact mechanism.

The spring-receiving guided element 130 can take many shapes, including but not limited to, for example, circular, oval, hexagonal, and rectangular cross-sections. When a circular cross-section is used, the spring-receiving guided element 130 can be made rotationally symmetrical such that it is free to rotate in the drive element 4 as, for example, when the collar 28 is rotated on the drive element 4.

The spring-receiving guided element 130 may be formed of a single piece or more than one piece so long as a portion of the guided element 130 partially overlaps the biasing element. The spring-receiving guided element 130 may be manufactured by any suitable process including, stamping, pressing, molding, sintering, welding, extruding, polymerizing, lithography, or the like, depending on the material of the spring-receiving guided element. Where the spring-receiving guided element includes a recess to receive the biasing element, the recess may be formed by drilling, punching, molding, sintering, or other suitable technique for creating a recess.

The spring-receiving guided element 130 may be formed from a variety of materials such as but not limited to metal, ceramic, or plastic including any variety of polymers such as polycarbonate, polyvinyl chloride, polyethylene, polypropylene, polystyrene, and polytetrafluoroethylene, aramid and aramid fibers. In short, any suitable material is contemplated so long as the spring-receiving guided element 130 can perform the described functions.

Referring now to FIG. 6, one embodiment of a spring-receiving guided element 130 is shown. The guided element 130 includes a first portion 132 and second portion 140. In this embodiment, the second portion 140 is generally orthogonal to the first portion 132. The first portion 132 is shaped as a plate 134 such that the biasing element 62 and the engaging element 18 are positioned on opposite sides of the first portion 132 and thus the plate 134.

The second portion 140 in this embodiment includes four arms 142*a*, 142*b*, 142*c*, and 142*d*. While FIG. 6 shows four arms, the guided element 130 may have a single arm, two arms, or three arms as described in more detail below. The arm or arms 142*a*, 142*b*, 142*c*, and 142*d* extend alongside the biasing element 62 in the longitudinal direction 80. Where the second portion 140 includes two arms, they may be oriented opposite each other or may be orthogonal to each other. The arms 142 may extend a portion of the length of the biasing element such that the guided element 130 partially overlaps the biasing element 62 along the longitudinal axis 80.

Advantageously, in the embodiment shown in FIG. 6, the guided element 130 may be formed as an integral single piece of material where the arms 142*a*, 142*b*, 142*c*, and 142*d* are defined by folds 146 in the material and one arm is connected to the second portion 140 by a fold 146. Alternatively, the guided element may be formed by joining a first portion 132 to a second portion 140 in a known manner such as by brazing, welding, or other conventional methods of joining materials.

Also, in the embodiment shown in FIG. 6, the guided element 130 has a generally rectilinear cross-sectional shape and four arms are defined, as noted above, it is contemplated that the guided element 130 could have a generally circular or oval cross-sectional shape. In this, instance, the second portion could define a single continuous arm.

Turning back to FIG. 1, the collar 28 includes a ledge 42 in at least a portion of an inner perimeter thereof. A portion of the guided element 130 is positioned to contact the ledge 42, at least when the collar 28 is moved toward a releasing position. In this example, the ledge 42 extends completely around the inner perimeter of the collar 28, such that the collar 28 is freely rotatable around the longitudinal axis 80 with respect to drive element 4 and the guided element 130. In this embodiment, the guided element is substantially covered by the collar 28.

As shown in FIG. 6, the arm 142*a* of the second portion 140 may have an arcuately shaped surface such that when the guided element 130 is located in the guide 38 the arcuate surface of the arm 142*a* may recapitulate the curvature of the collar 28. Advantageously, when the one arm 142*a* has a surface shape that recapitulates the inner surface shape of the collar 28, the likelihood that the guided element 130 will jam is minimized. In addition, if the one arm 142*a* recapitulates the inner surface shape of the collar 28, the likelihood of the guided element 130 being retained in the guide 38 is enhanced.

In this embodiment, the first portion 132 has an edge 133 proximate to an edge or protrusion 144*a* of the arm 142*a*. The edge or protrusion 144*a* can, if desired, overlap the edge 133. Alternatively, it is contemplated that the edge 133 can, if desired, overlap the edge or protrusion 144*a* of the arm 142*a*. In either case, in the embodiment shown in FIG. 6, the edge 133 is shaped to recapitulate the inner surface of the collar 28.

Either the first portion 132 or the second portion 140 may be configured to contact the ledge 42. In the embodiment of the guided element 130 shown in FIG. 6, the second portion 140 can engage the actuating element, particularly the collar 28. The edge or protrusion 144*a* on arm 142*a* can engage the ledge 42. As noted above, the arm 142*a* recapitulates the inner surface of the collar 28 and thus, the ledge 42 to provide robust surface to surface contact between the edge or protrusion 144*a* and the ledge 42.

Alternatively as noted above, the guided element 130 can be configured so that the edge 133 overlaps the edge or protrusion 144*a* of the arm 142*a*. Of course, it will be understood that when the edge 133 overlaps the edge or protrusion 144*a* of the arm 142*a*, a segment of the first portion 132 may be configured to be in surface contact with the ledge 42.

Figure 8:
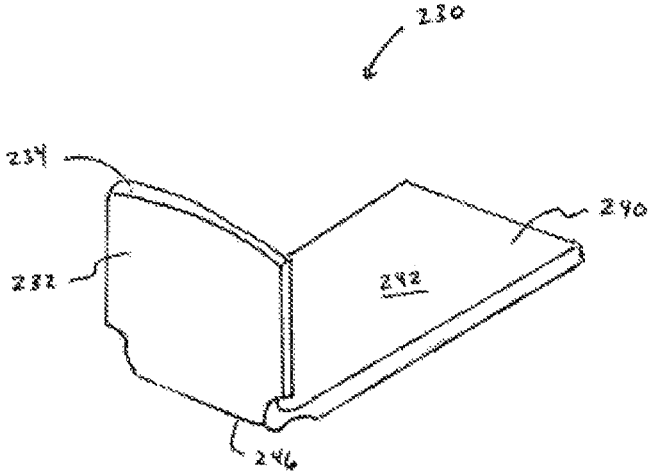
FIG. 8 is a perspective view of another embodiment of a spring-receiving guided element.
Figure 9:
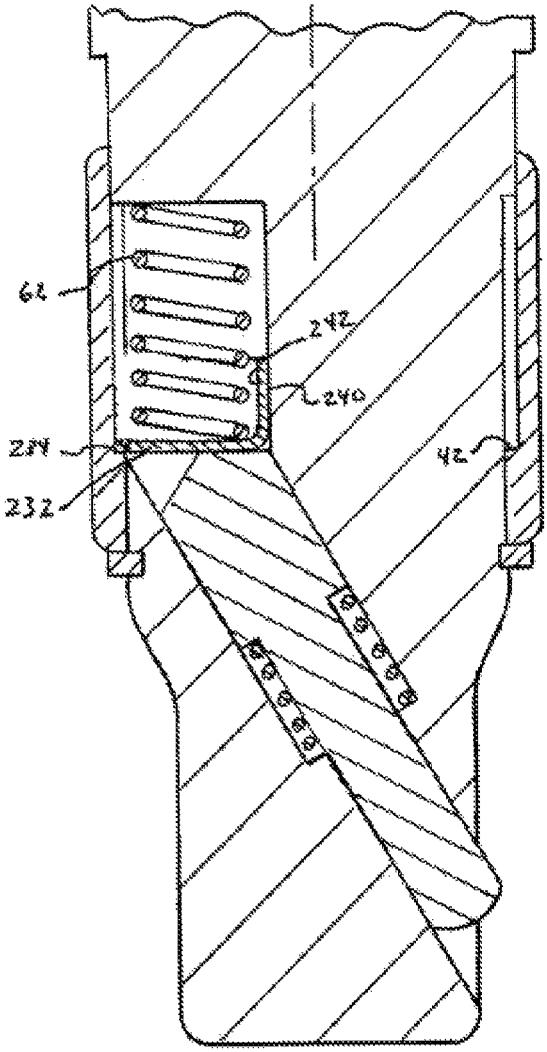
FIG. 9 is a longitudinal sectional view of the tool of FIG. 1 with the spring-receiving guided element of FIG. 8.

As noted above, the guided element need not be provided with four arms. For example, FIG. 8 shows one embodiment of a guided element 230 where the first portion 232 is connected to a second portion 240 to define a single arm 242. The first portion 232 may be connected to the second portion 240 at a connection 246 in the form of a seam, joint, fold, or the like. The first portion 232 has an edge 234 with a shape that recapitulates the inner surface of the collar 28. By forming the edge 234 in this manner, the guided element 230 can be located within the guide 38. In addition, the likelihood that the guided element 130 will jam is minimized and the likelihood of the guided element 130 being retained in the guide 38 is enhanced. In this embodiment, a segment of the first portion 232 proximate the edge 234 engages the ledge 42 as best seen in FIG. 9.

Figure 10:
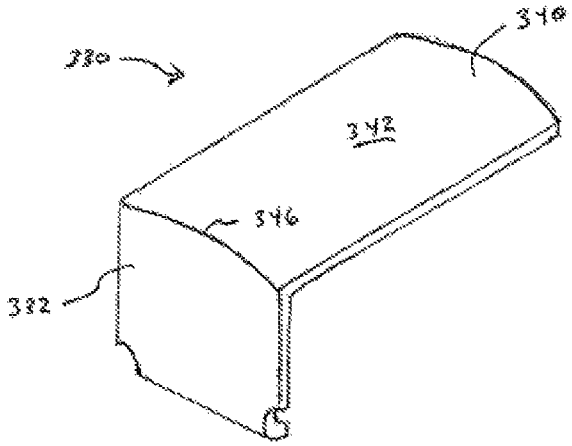
FIG. 10 is a perspective view of another embodiment of a spring-receiving guided element.
Figure 11:
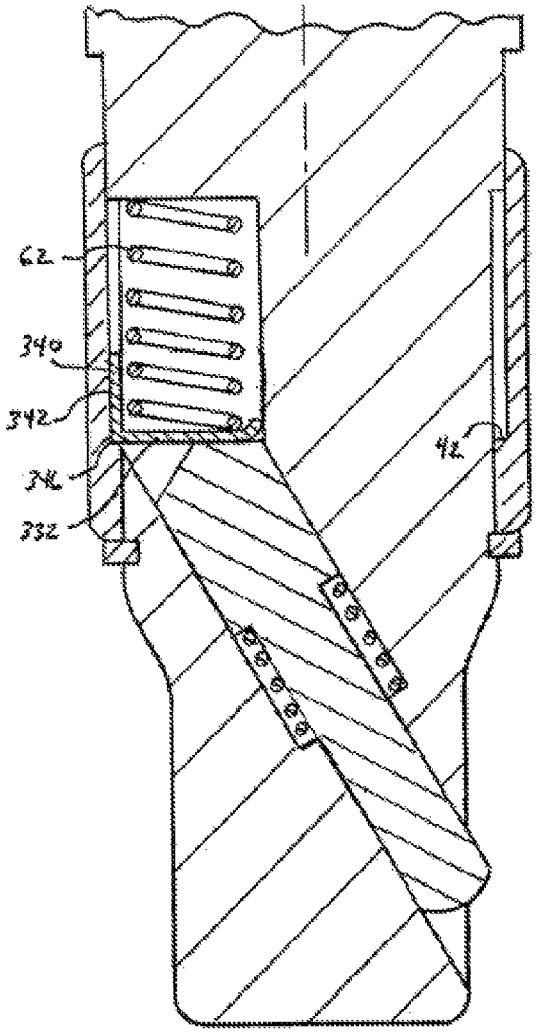
FIG. 11 is a longitudinal sectional view of the tool of FIG. 1 with the spring-receiving guided element of FIG. 10.

FIG. 10 shows another embodiment of a guided element 330 where the first portion 332 is connected to a second portion 340 to define a single arm 342. In this embodiment, the arm 342 is shaped to recapitulate the inner surface shape of the collar 28. When the arm 342 is shaped to recapitulate the inner surface of the collar 28, the guided element 330 is more likely to be correctly located and retained in the guide 38. Arrangement of the guided element 330 with the drive element 4 is shown in FIG. 11. The first portion 332 is connected with the second portion 340. The first portion 332 may be connected to the second portion 340 at a connection 346 that may be in the form of a seam, joint, fold, or the like. In this embodiment, a segment of the first portion 332 proximate the connection 346 may be in contact with the ledge 42. While each of the guided element embodiments depicted in FIGS. 8 and 10 are formed from an integral piece of material, it is appreciated that the first portion and the second portion could be separate and joined together during manufacturing.

Figure 12:
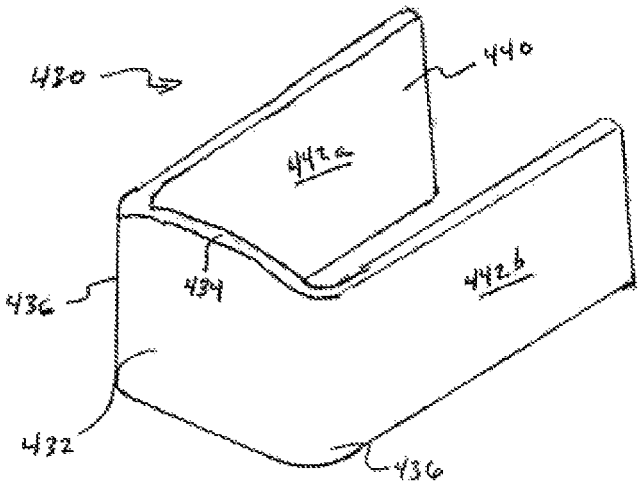
FIG. 12 is a perspective view of an embodiment of a spring-receiving guided element.

FIG. 12 shows a guided element 430 where the first portion 432 is joined with a second portion 440 that includes two arms 442*a* and 442*b*. The first portion may include an edge 434 with a shape that recapitulates the inner surface of the collar 28. By forming the edge 434 in this manner, the guided element 430 is more likely to be located and retained within the guide 38. In this embodiment, at least a segment of the first portion 432 proximate the edge 434 may at least in part engage the ledge 42. Alternatively, the guided element 430 may be arranged within the guide 38 so that a section 436 connecting the first portion 432 to the second portion 440 may at least in part engage the ledge 42.

Figure 13:
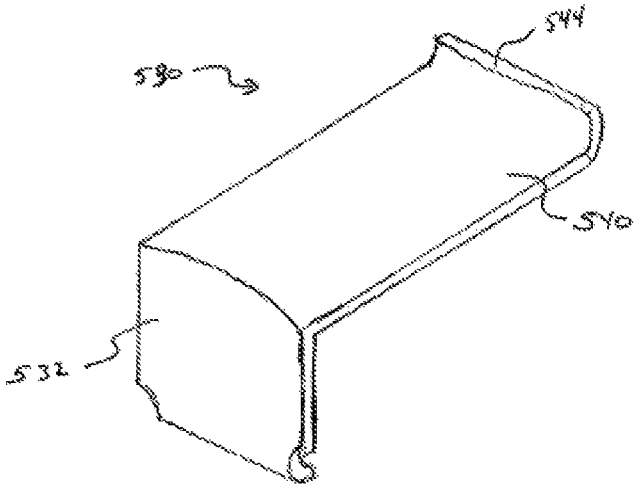
FIG. 13 is a perspective view of an embodiment of a spring-receiving guided element.
Figure 14:
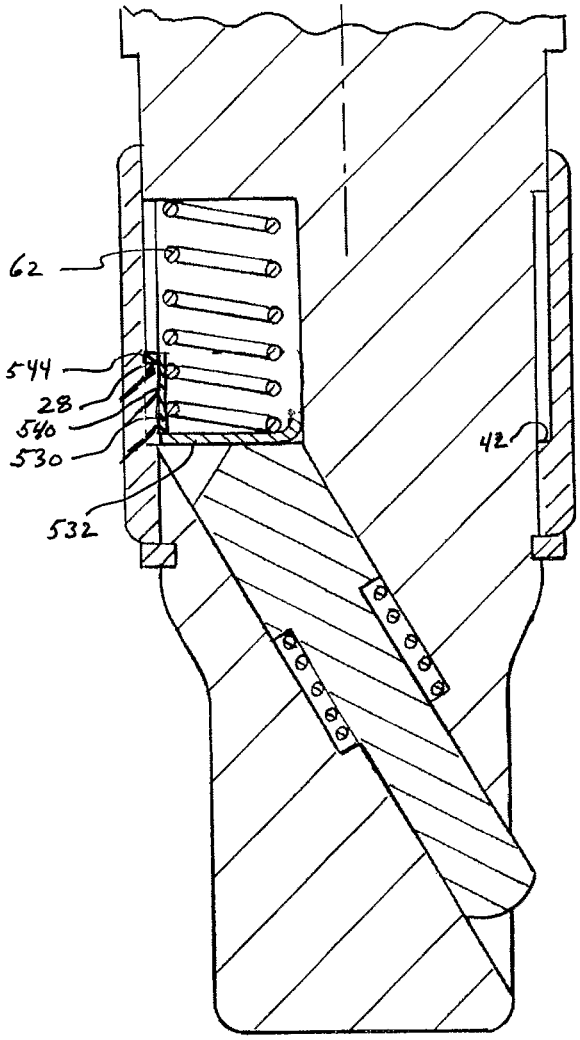
FIG. 14 is a longitudinal sectional view of the tool of FIG. 1 that includes the spring-receiving guided element of FIG. 13.

FIG. 13 shows another embodiment of a guided element 530 where the protrusion 544 is distal to the first portion 532 and extends outwardly from the second portion 540 to engage the ledge 42 best seen in FIG. 14 when the actuating element 28 is moved. FIG. 14 shows the guided element 530 of FIG. 13 located within a drive element 4 according to FIG. 1.

Turning back to FIG. 1, the collar 28 extends around the outer circumferential periphery of the upper portion 6. It is to be understood that alternative structures, including but not limited to those that extend only partially around a circumference and those that have a short longitudinal length, may likewise be employed.

The collar 28 may be fashioned as an integral structure or from one or more pieces joined together. When the collar 28 is formed from more than one piece, each piece may be joined to the other in any known manner and may be joined parallel to the longitudinal axis 80, orthogonal to the longitudinal axis 80, or both.

The drive element 4 defines a step 48. As shown in FIG. 1, the step 48 extends around the drive element 4. The step 48 is optional and may be provided to simplify assembly of the drive element 4. The collar 28 further includes first and second guide surfaces 44, 46, which center the collar 28 on the drive element 4 on both sides of the guided element 130. The guide surface 46 slides on a smaller-diameter surface of the drive element 4 on one side of the step 48, and the guide surface 44 slides on larger-diameter surface of the drive element 4 on the other side of the step 48. As shown in FIG. 1, the drive element 4 may be provided with a larger-diameter portion above the region reached by the collar in its uppermost position.

Tools embodying features of the present invention preferably include at least one biasing element that provides automatic engagement with a tool attachment once the tool has been assembled with the tool attachment. In some embodiments, such automatic engagement can operate after the exposed end of the engaging element is pushed to a releasing position by a tool attachment as the drive stud is inserted into the tool attachment. In other words, automatic engagement operates in a manner such that after the drive stud 10 is fully inserted into the tool attachment, the engaging member is in the engaging position, all without any movement of the actuating member by the user or otherwise. Automatic engagement can also be useful after the actuating element has been used to move the engaging element to a releasing position. In alternative embodiments in which engagement is to be manually initiated by an operator's movement of an actuating element, no biasing element may be required. In one alternative, a detent can be used to hold the actuating element in one or more positions, such as an engaging position and a releasing position.

The embodiment of FIG. 1 includes two biasing elements: a releasing spring 60 and an engaging spring 62. The releasing spring 60 bears on a shoulder of the engaging element 18 to bias the engaging element 18 toward the releasing position. The engaging spring 62 bears on the spring-receiving guided element 130 to bias the spring-receiving guided element 130 toward the engaging element 18. The spring force supplied by the engaging spring 62 is greater than that supplied by the releasing spring 60 such that, in the absence of externally-applied forces, forces from the engaging spring 62 hold the engaging element 18 in the engaging position shown in FIG. 1. In alternate embodiments, a single spring may be used.

In this embodiment the springs 60, 62 are compression-type coil springs, though many other types of biasing elements can be configured to perform the biasing functions described above. In alternate embodiments, the biasing elements may be implemented in other forms, placed in other positions, bias the engaging element and the actuating element in other directions, and/or be integrated with or coupled directly to other components.

FIGS. 1-3 show the illustrated mechanism in three separate positions. The position of FIG. 1 is the normal rest position, in which the engaging spring 62 overcomes the biasing force of the releasing spring 60 to hold the engaging element 18 in the engaging position.

As shown in FIG. 2, when external forces are applied to move the collar 28 in a direction away from drive stud 10, the collar 28 moves the guided element 130 away from the drive stud 10. This allows the lower portion 24 of the engaging element 18 to move out of or to be moved out of its engaging position (i.e., out of any position in which the terminus of the lower portion 24 projects outwardly from drive stud 10 sufficiently to engage the tool attachment).

When the collar 28 is allowed to move away from the position of FIG. 2, the biasing force of the engaging spring 62 again overcomes the biasing force of the releasing spring 60, thereby moving the spring-receiving guided element 130 toward the drive stud 10. This motion of the spring-receiving guided element 130 causes the cam surface 136 to move the engaging element 18 toward the position of FIG. 1.

As shown in FIG. 3, when the drive stud 10 is simply pushed into a tool attachment, the tool attachment can push the engaging element 18 into the drive stud 10, compressing the engaging spring 62 in the process. In this embodiment, the spring-receiving guided element 130 is able to move away from the drive stud 10 under the force of the engaging element 18 without moving the collar 28 away from the drive stud 10. In this way, a tool attachment can be placed on the drive element 4 and be automatically engaged without requiring movement of the collar 28.

If desired, an optional spring (not shown) may be provided to bias the collar 28 toward the drive stud 10, thereby holding the collar 28 in the position shown in FIG. 3 when the engaging element 18 is pushed into the passageway 12 by a tool attachment, although it is envisioned that this result may be achieved through gravity if the drive stud 10 is at a position below the upper portion 6 or by shaking the drive element 4.

Because the region of contact between the engaging element 18 and the spring-receiving guided element 130 remains within the drive element 4, the collar 28 can be provided with an unusually small outer diameter for a given size of the drive stud 10.

In some embodiments, the spring-receiving guided element and the engaging element coupled thereto may be provided as physically unconnected pieces. In alternative embodiments, the guided element may be physically tethered to the engaging element, such as by a flexible connecting member similar to the flexible tension member 40 described in U.S. Pat. No. 5,214,986, the entire contents of which are incorporated herein by reference, except that in the event of any inconsistent disclosure or definition from the present application, the disclosure or definition herein shall be deemed to prevail. In these alternative embodiments, the flexible member may be provided as either a compression member, as a tension member, or both, such that a function of the flexible member may be to push and/or pull one or more parts tethered thereto.

Figure 4:
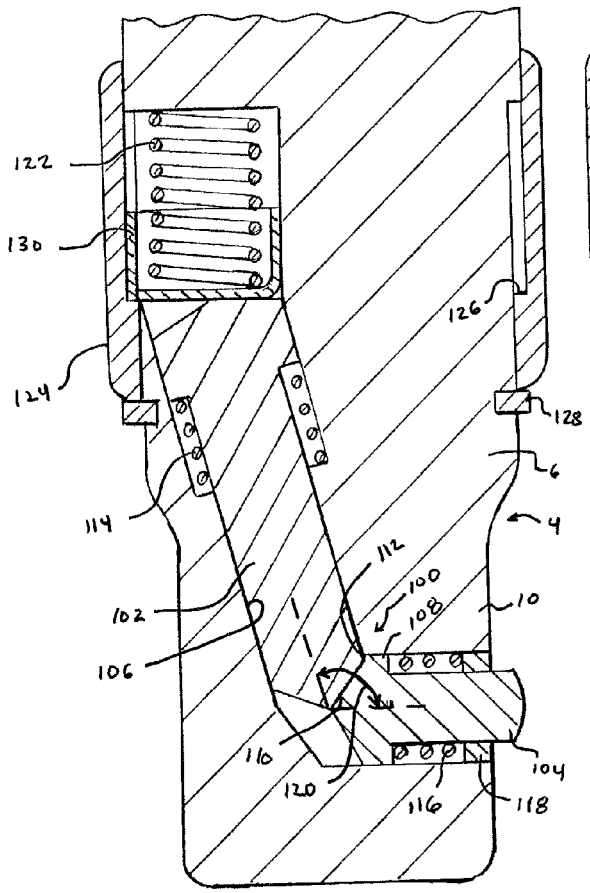
FIG. 4 is a longitudinal sectional view of a tool that includes a second embodiment of a mechanism for altering engagement forces.
Figure 5:
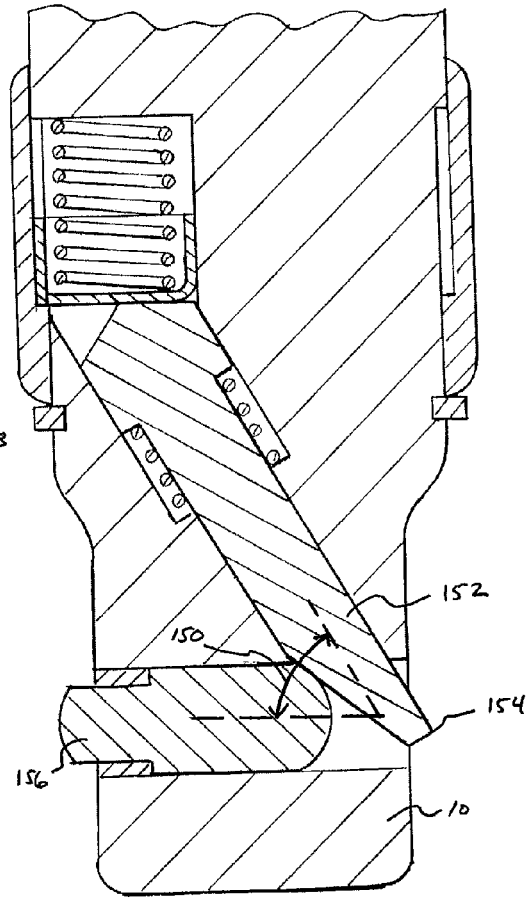
FIG. 5 is a longitudinal sectional view of a tool that includes a third embodiment of a mechanism for altering engagement forces.

FIGS. 4 and 5 illustrate preferred embodiments of the present invention that use a multiple-part engaging element. In these figures the reference symbols 4, 6, and 10 designate comparable parts to those described above in conjunction with FIG. 1. The drive element 4 of FIG. 4 carries a two-part engaging element 100 that includes a first part 102 and a second part 104. The first part 102 is guided by an oblique passageway that functions as a first guide 106, and this first guide 106 is oriented at an oblique angle with respect to the longitudinal axis of the tool. The tool also defines an additional guide 108 which in this embodiment is positioned transversely to the longitudinal axis. This additional guide 108 is also formed as a passageway, and the second part 104 is at least partially disposed in the additional guide 108. The first part 102 defines a cam surface 110 and the second part 104 defines a cam surface 112. A first releasing spring 114 biases the first part 102 upwardly, away from the drive stud 10, and a second releasing spring 116 biases the second part 104 into the drive stud 10. As illustrated, a retainer 118 can be press fit or otherwise mounted in the additional guide 108 to provide a reaction surface for the second releasing spring 116 or may be peened or otherwise fitted so as to be mounted in the additional guide 108.

In alternative embodiments, the releasing spring 114 can be eliminated if the releasing spring 116 exerts sufficient forces biasing the first part 102 toward the spring receiving guided element 130. Also, in other alternative embodiments, the spring 116 can be eliminated, as described below in conjunction with FIG. 5.

A spring-receiving guided element 130 biased by an engaging spring 122 is coupled to the first part 102 and these parts operate in a manner similar to the spring-receiving guided element 130 and the engaging spring 62 described above in conjunction with FIG. 1. The spring-receiving guided element 130 is at least at some times coupled to an actuating element, which in this embodiment defines a collar 124 that defines a ledge 126. The collar 124 is held in place on the tool by a retainer 128, and the outer surface of the drive element 4 guides the longitudinal and rotational movement of the collar 124.

FIG. 4 shows the illustrated mechanism in the rest position, in which the biasing force of the engaging spring 122 overcomes the biasing forces of the releasing springs 114, 116 to move the first part 102 to the position shown in FIG. 4. In this position, the cam surface 110 of the first part 102 holds the second part 104 in a tool attachment engaging position, in which a protruding end of the second part 104 is positioned to engage a recess or bore in a socket or a tool attachment (not shown).

When an operator wishes to release a tool attachment, the collar 124 is moved away from the drive stud 10, thereby compressing the engaging spring 122. The releasing springs 114, 116 then move the first part 102 upwardly and the second part 104 inwardly, such that the protruding end of the second part 104 moves toward the drive stud 10. In this way a tool attachment is released.

In this embodiment, the second part 104 defines a generally cylindrical portion designed to provide a positive interlock with a cooperating opening or detent in a tool attachment. This provides a particularly secure and reliable engagement with the tool attachment.

The reference symbol 120 is used to designate an included angle between the first guide 106 and the additional guide 108. In this embodiment, the included angle is greater than 90°, as illustrated.

The mechanism of FIG. 5 also includes a multiple-part engaging element, and there are three primary differences between the mechanisms of FIGS. 4 and 5. First, the included angle 150 in this embodiment is less than 90°. Second, in this embodiment the first part 152 is provided with an end 154 that is positioned to extend out of the drive stud 10 when the first part 152 is in the engaging position shown in FIG. 5. This arrangement engages a tool attachment on two opposite sides of the drive stud 10. On one side (to the left as shown in FIG. 5) the second part 156 is moved into a complementary opening in the side wall of the tool attachment. On the other side (to the right as shown in FIG. 5) the end 154 of the first part 152 presses against the tool attachment to wedge the drive stud 10 in the tool attachment. The wedging function of this arrangement may be useful for retaining sockets or tool attachments that lack detents or holes that heretofore have been present in socket and tool attachments. Third, in this embodiment the second part 152 is not provided with a biasing element. This embodiment is designed for applications that require the operator to manually move the second part 152 into the drive stud (as for example by shaking or with a pin or the like) in order to release a tool attachment.

If desired, the end 154 may be configured to remain within the drive stud 10 for all positions of the mechanism. If this is done, the face of the drive stud near the end 154 may remain solid, without any through openings.

The embodiments described above all provide the advantage that the actuating element can be sized to extend radially away from the longitudinal axis 80 only a small distance beyond the exterior of the drive element 4. When the actuating element includes a collar, and the drive stud includes two opposed faces, the ratio of the maximum outside diameter D1 of the collar to the face-to-face separation D2 between the two opposed faces is a measure of the extent to which the collar protrudes. FIG. 2 shows one example of how to measure D1 and D2, where two opposed faces of the drive stud 10 are indicated by the reference number 11. Of course, similar measurements can be made with the other illustrated embodiments that include a collar.

In various applications, for any given tool size for insertion into a socket r tool attachment, the ratio D1/D2 can be made to equal a wide range of desired values, for example, including those listed in the following table (all dimensions in inches):

| D1 | D2 | D1/D2 |
|---|---|---|
| .510 | .375 | 1.360 |
| .520 | .375 | 1.387 |
| .530 | .375 | 1.413 |
| .540 | .375 | 1.440 |
| .550 | .375 | 1.467 |
| .560 | .375 | 1.493 |
| .570 | .375 | 1.520 |
| .580 | .375 | 1.547 |
| .590 | .375 | 1.573 |
| .600 | .375 | 1.600 |
| .610 | .375 | 1.627 |
| .620 | .375 | 1.653 |
| .630 | .375 | 1.680 |
| .640 | .375 | 1.707 |
| .650 | .375 | 1.733 |
| .660 | .375 | 1.760 |
| .670 | .375 | 1.787 |
| .680 | .375 | 1.813 |
| .690 | .375 | 1.840 |
| .700 | .375 | 1.867 |
| .710 | .375 | 1.893 |

The foregoing table provides examples of collar dimensions for a ⅜ inch drive size, but it should be understood that collars for drive elements of other drive sizes can be provided with similar ratios of D1/D2. Also, even smaller ratios D1/D2 can be provided with this invention.

Throughout this description and in the appended claims, the following definitions are to be understood:

The term "coupled" and various forms thereof are intended broadly to encompass both direct and indirect coupling. Thus, a first part is said to be coupled to a second part when the two parts are directly coupled (e.g. by direct contact or direct functional engagement), as well as when the first part is functionally engaged with an intermediate part which is in turn functionally engaged either directly or via one or more additional intermediate parts with the second part. Also, two parts are said to be coupled when they are functionally engaged (directly or indirectly) at some times and not functionally engaged at other times.

The term "engage" and various forms thereof, when used with reference to retention of a tool attachment, refer to the application of any forces that tend to hold a tool and a tool attachment together against inadvertent or undesired separating forces (e.g., such as may be introduced during use of the tool). It is to be understood, however, that engagement does not in all cases require an interlocking connection that is maintained against every conceivable type or magnitude of separating force. In other words, "engage" connotes a positive retention of the tool that resists pulling off a tool attachment to a greater degree than is customarily the case with traditional spring-loaded ball retention mechanisms heretofore used in tools.

The designations "upper" and "lower" used in reference to elements shown in the drawings are applied merely for convenience of description. These designations are not to be construed as absolute or limiting and may be reversed. For the sake of clarity, unless otherwise noted, the term "upper" generally refers to the side of an element that is farther from a coupling end such as a drive stud. In addition, unless otherwise noted, the term "lower" generally refers to the side of an element that is closer to the coupling end.

The term "longitudinal" refers to directions that are generally parallel to the length direction of the drive element. In the embodiments described above, the longitudinal direction is generally parallel to the longitudinal axis 80.

The term "element" includes both single-part components and multiple-part components. Thus, an element may be made up of two or more separate components that cooperate to perform the function of the element.

As used herein, movement of an element toward a position (e.g., engaging or releasing) or toward a particular component (e.g., toward or away from a drive stud) includes all manner of longitudinal motions, skewed motions, rotational motions, and combinations thereof.

The term "relative movement" as applied to translation between two parts refers to any movement whereby the center of mass of one part moves in relation to the center of mass of another part.

The term "cam surface" refers broadly to a surface that is shaped such that relative movement in a first direction between the cam surface and a second element in contact with the surface can cause the second element to move relatively in a second direction, different from the first direction. Cam surfaces may be of various types and shapes, including, without limitation, translating cam surfaces, rotating cam surfaces, and cam surfaces that both translate and rotate.

As used herein, the term "biasing element" refers to any device that provides a biasing force. Representative biasing elements include but are not limited to springs (e.g., elastomeric or metal springs, torsion springs, coil springs, leaf springs, tension springs, compression springs, extension springs, spiral springs, volute springs, flat springs, and the like), detents (e.g., spring-loaded detent balls, cones, wedges, cylinders, and the like), pneumatic devices, hydraulic devices, and the like, and combinations thereof.

The tools described above are characterized in varying degrees by some or all of the following features: simple construction; a small number of easily manufactured parts; easy access to an operator using the tool in a tight and/or restricted workspace; rugged, durable, and reliable construction; an ability to accommodate various tool attachments, including those with various sizes and configurations of recesses designed to receive a detent; self-adjusting for wear; substantially eliminating any precise alignment requirements; readily cleanable; presenting a minimum of snagging surfaces; extending outwardly from the tool by a small amount; and having a short longitudinal length.

The mechanisms illustrated in the drawings include actuating elements that have a maximum cross-sectional dimension that is only slightly larger than that of the drive elements on which they are mounted. Such an actuating element brings several advantages. Since the actuating element has a small outside diameter, the resulting tool is compact and easily used in tight spaces. Also, the actuating element is less subject to being accidentally moved to the releasing position during use, because it presents a smaller cross-section than many tool attachments.

Of course, it should be understood that a wide range of changes and modifications can be made to the preferred embodiments described above. For example, the multiple-part engaging elements of FIGS. 4 and 5 can be used with the widest variety of actuating elements and biasing elements, including appropriate ones of the actuating elements and biasing elements shown in the other figures. Similarly, the illustrated actuating elements can be used with a wide variety of engaging elements. In general, features can be selected from two or more of the embodiments described above and combined to produce many additional embodiments of the invention. Also, for convenience various positions of the cam surfaces, the engaging elements and the actuating elements have been described. It will of course be understood that the term "position" is intended to encompass a range of positions, as is appropriate for tool attachments that have recesses and bores of varying shapes and dimensions.

It is therefore intended that the foregoing detailed description be regarded as illustrative rather than limiting, and that it be understood that it is the following claims, including all equivalents, which are intended to define the scope of this invention.

We claim:

1. A tool for detachably engaging a tool attachment, said tool comprising:

a drive element for transmitting torque to the tool attachment, said drive element having a longitudinal axis; and a mechanism for altering engagement forces between the tool attachment and the drive element, said mechanism comprising:

an actuating element moveably carried by the drive element and movable with respect to the drive element by a user;

an engaging element to engage the tool attachment, wherein the engaging element is moveably carried within a bore provided in the drive element and that is oriented at an obtuse angle to the longitudinal axis and wherein the actuating element is coupled to the engaging element at a region positioned at least partly within a channel formed in the drive element;

a biasing element biasing the engaging element toward engagement with the tool attachment wherein the biasing element is disposed entirely on one side of the longitudinal axis and wherein a biasing force at the biasing element is oriented at an angle to a path of a portion of the engaging element that receives the biasing force; and, a guided element coupled between the engaging element and the biasing element, said guided element being movable relative to the engaging element and also coupled to the actuating element such that user-initiated movement of the actuating element in a selected direction causes the guided element at least in part to overcome the biasing force of the biasing element;

said guided element partially overlapping the biasing element along the longitudinal axis.

2. The invention of claim 1 wherein the guided element extends alongside the biasing element on at least two opposed sides of the biasing element.

3. The invention of claim 1 wherein the guided element extends alongside the biasing element on at least two pairs of opposed sides of the biasing element.

4. The invention of claim 1 wherein the guided element comprises a first portion, wherein the biasing element and the engaging element are positioned on opposite sides of the first portion.

5. The invention of claim 4 wherein the guided element comprises a second portion that extends alongside the biasing element.

6. The invention of claim 5 wherein the second portion is shaped to engage the actuating element.

7. The invention of claim 6 wherein the actuating element comprises a first arcuate surface positioned to engage the second portion, and wherein the second portion comprises a second arcuate surface positioned to engage the first arcuate surface.

8. The invention of claim 6 wherein the first portion comprises a plate shaped and positioned to engage the biasing element and the engaging element.

9. The invention of claim 6 wherein the second portion further comprises a protrusion to engage the actuating element.

10. The invention of claim 9 wherein the protrusion is proximate to the first portion.

11. The invention of claim 9 wherein the protrusion is distal to the first portion.

12. The invention of claim 5 wherein the first portion comprises a plate, wherein the second portion comprises a plurality of arms, and wherein the plate and the arms are integrally formed from a single sheet of material.

13. The invention of claim 12 wherein at least one of the arms is connected to the plate at a fold in the sheet of material.

14. The tool of claim 1 wherein the guided element has a portion shaped to engage the actuating element.

15. The tool of claim 1 wherein the guided element includes a first portion and a second portion with the biasing element and the engaging element positioned on opposite sides of the first portion and with the second portion shaped to engage the actuating element.

16. The tool of claim 1 wherein the biasing element applies a force at the engaging element that is at an angle with respect to a path travelled by the engaging element.

17. The tool of claim 1 wherein the guided element moves in a direction that is oriented obliquely to a direction in which the engaging element moves.

18. The tool of claim 1 wherein the actuating element travels in a direction parallel to the longitudinal axis.

19. A tool for detachably engaging a tool attachment, said tool comprising:

a drive element for transmitting torque to the tool attachment, said drive element having a longitudinal axis; and a mechanism for altering engagement forces between the tool attachment and the drive element, said mechanism comprising:

an actuating element moveably carried by the drive element and movable with respect to the drive element by a user;

an engaging element moveably carried by the drive element to engage the tool attachment;

a biasing element biasing the engaging element toward engagement with the tool attachment; and, a guided element having a first portion disposed between the engaging element and the biasing element, the guided element having a second portion shaped to engaging the actuating element such that user-initiated movement of the actuating element in a selected direction causes the guided element at least in part to overcome the biasing force of the biasing element;

the second portion of the guided element partially overlapping the biasing element along the longitudinal axis.

* * * * *